US006149006A

United States Patent [19]

Brauner et al.

[11] Patent Number: 6,149,006

[45] Date of Patent: Nov. 21, 2000

[54] REFRIGERATED FOOD PRODUCT CONTAINER

[75] Inventors: Arne H. Brauner, Minnetonka; Gary S. Bachand; John Rebhorn, both of Maple Grove, all of Minn.

[73] Assignee: General Mills, Inc., Minneapolis, Minn.

[21] Appl. No.: 08/912,822

[22] Filed: Aug. 19, 1997

[51] Int. Cl.[7] ..... A45C 11/20

[52] U.S. Cl. ..... 206/551; 206/232; 206/557

[58] Field of Search ..... 206/557, 558, 206/503, 505, 507, 551, 459.5, 775, 776, 781, 782, 232; 40/312; 220/605, 665; 426/112, 115, 106; D9/550; 229/902–904, 905, 906

[56] References Cited

U.S. PATENT DOCUMENTS

| | | | |
|---|---|---|---|
| D. 249,233 | 9/1978 | Florian . | |
| D. 283,400 | 4/1986 | Forbers, Jr. . | |
| D. 286,618 | 11/1986 | Kea et al. . | |
| D. 305,410 | 1/1990 | Tyler . | |
| D. 310,748 | 9/1990 | Embree et al. . | |
| D. 342,896 | 1/1994 | Gottsfredi . | |
| D. 345,911 | 4/1994 | Elbaz . | |
| D. 388,324 | 12/1997 | Bonnard . | |
| D. 400,099 | 10/1998 | Brauner et al. . | |
| 2,886,826 | 5/1959 | Lattuca | 206/557 |
| 2,990,948 | 7/1961 | Zackheim . | |
| 3,027,045 | 3/1962 | Wilson | 206/505 |
| 3,061,087 | 10/1962 | Scrivens et al. . | |
| 3,101,870 | 8/1963 | Betner . | |
| 3,428,460 | 2/1969 | Ely | 426/112 |
| 3,515,334 | 6/1970 | Jacobson | 229/903 |
| 3,615,039 | 10/1971 | Bostrom . | |
| 3,880,285 | 4/1975 | March | 229/406 |
| 4,605,142 | 8/1986 | Itoh et al. . | |
| 4,616,762 | 10/1986 | Alexander . | |
| 4,765,463 | 8/1988 | Chanel . | |
| 4,834,247 | 5/1989 | Oshima et al. . | |
| 4,947,985 | 8/1990 | Crabtree et al. | 426/112 |
| 4,990,345 | 2/1991 | Webb | 426/112 |
| 5,125,529 | 6/1992 | Torterotot . | |
| 5,160,767 | 11/1992 | Genske et al. . | |
| 5,167,339 | 12/1992 | Takata et al. . | |
| 5,269,430 | 12/1993 | Schlampitz et al. . | |
| 5,516,035 | 5/1996 | Stone . | |
| 5,520,939 | 5/1996 | Wells | 426/112 |
| 5,582,293 | 12/1996 | Kay | 206/459.5 |
| 5,695,798 | 12/1997 | Rozzano | 206/557 |

OTHER PUBLICATIONS

Jon Donaire® Pastries, Inc./Presto FoodService, "Cheesecake by the Slice," undated brochure (front to back 1 page) re portion–pak portioned (individual) cheesecakes.

(List continued on next page.)

*Primary Examiner*—Paul T. Sewell
*Assistant Examiner*—Luan K. Bui
*Attorney, Agent, or Firm*—John A. O'Toole; L. MeRoy Lillehaugen; Alan D. Kamrath

[57] ABSTRACT

A container (10) especially adapted for wedge shaped food products is disclosed including a transparent, thermoformed tray (11) receiving a paperboard product card (32) and sealed by a transparent closure layer (15). The tray (11) includes an isosceles trapezoid shaped bottom (16) and a sidewall (18) formed by a first, isosceles trapezoid shaped end (20), sides (24, 26) extending at an angle between an annular flange (12) and the bottom (16) from their upper edges to their lower edges and from their first end edges to their second end edges, a second trapezoid shaped end (22), and a triangular shaped corner panel (28). The product card (32) includes a bottom portion (34) of a size and shape for abutting with the bottom (16) of the tray (11) and end and side portions (36, 40) integrally connected to the bottom portion (34) about fold lines (38, 42) for abutting with the first end (20) and first side (24) of the tray (11). Printing on the outer surfaces of the product card (32) can be viewed through the bottom (16) and first end (20) and side (24) of the tray (11) while the interior of the tray (11) can be viewed through the second end (22) and side (26) and the corner panel (28) of the tray (11).

17 Claims, 2 Drawing Sheets

OTHER PUBLICATIONS

Jon Donaire® Desserts/Presto Food Products, Inc., untitled brochure (front to back 1 page) re individual cheesecakes, lists convenience store, in–store service deli and self–service.

Jon Donaire® Desserts, "Portion Pack Desserts from Jon Donaire, ®" undated brochure (front to back 1 page) re product features and advantages/individual cheesecakes, lists fast food drive–thru and school cafeteria.

Packaging Cat, p. 21, 1983.

REFRIGERATED FOOD PRODUCT CONTAINER

BACKGROUND

The present invention generally relates to containers, particularly to containers including thermoformed trays, and specifically to containers including transparent thermoformed trays for refrigerated food products.

In the marketing of food products, it is often necessary to seal the food product in containers providing structural support and a barrier to the effects of environmental conditions. It is thus desirable to provide containers of a relatively low cost and which can be easily handled mechanically. Thermoformed containers are a preferred class which meet these characteristics and are widely utilized for refrigerated food products such as yogurt. However, it is relatively difficult to provide printing directly on thermoformed containers but rather the printing is provided on labels extending over the sidewall of the container and/or on the closure or lid for the container. In some cases, it is also desirable to be able to view the food products inside of the container. Thus, a preferred form is a container formed of transparent material. Placement of labels over transparent containers is then counterproductive as the labels and especially the printing thereon obstructs or otherwise limits viewing of the food products inside of the containers. Additionally, the application of labels to the outside surfaces of containers especially by mechanical means require large, smooth areas and thus limiting the potential shapes of the containers. It can also be appreciated that it is desirable to present food products in conventional shapes which are not necessarily cylindrical or parallelepiped shapes such as individual pieces of pie, individual slices of cheese cake, or the like. For packaging efficiency, it is desired that the containers have shapes which generally imitate or conform to the shape of the food products.

Thus, a need continues to exist for containers for refrigerated food products of generally wedge shapes which allow viewing of the food products inside of the container without opening the containers, which provide a relatively large presentation area for printed material, which are especially adapted for mechanical handling, and which otherwise overcome the deficiencies and shortcomings of prior containers.

SUMMARY

The present invention satisfies this need and solves other problems in the field of refrigerated food product containers by providing, in the preferred form, thermoformed trays each including sides having first portions extending generally straight downwardly and second portions extending downwardly therefrom at an angle inwardly to the bottom so that the trays can be nested with the first portions of the upper tray forcing the first portions of the lower tray outwardly to prevent a wedge effect between the second portions of the upper and lower trays.

In other aspects of the present invention, a product card of folded, flat stock material is provided in a transparent thermoformed tray, with the product card including a bottom portion of a size and shape corresponding to and for flushly abutting with the planar bottom of the tray and including at least a side portion integrally connected to a first side edge of the bottom portion about a fold line, with the bottom portion including a second side edge which is free of interconnection, with the fold line and the second side edge abutting with the sidewall of the tray with the side portion being pushed at an angle about the fold line relative to the bottom portion and abutting with the sidewall of the tray, with the food product being viewable through the portion of the sidewall of the tray adjacent the second side edge and printed material on the outer surface of the product card being viewable through the bottom and the portion of the sidewall of the tray adjacent the first side edge.

In still other aspects of the present invention, a thermoformed tray is provided including a generally rectangular opening and a generally isosceles shaped, planar bottom, with the sides of the tray generally extending at an angle inwardly from the opening to the bottom and having decreasing spacing from their first end edges to their second end edges. In preferred aspects of the present invention, the upper edges of the tray sidewall are integrally formed with an annular flange arranged parallel to the bottom, with the tray sidewall including a corner panel so that the annular flange includes an enlarged portion having greater spacing between the inner and outer peripheries of the flange so that the closure layer can be adhered to the flange spaced from the outer periphery in the enlarged portion for ease of removal of the closure layer.

It is thus an object of the present invention to provide novel containers for food products.

It is further an object of the present invention to provide such novel food containers for refrigerated food products.

It is further an object of the present invention to provide such novel food containers for wedge-shaped food products.

It is further an object of the present invention to provide such novel food containers generally formed of transparent materials.

It is further an object of the present invention to provide such novel food containers including a transparent, thermoformed tray.

It is further an object of the present invention to provide such novel food containers which are especially adaptable for mechanical handling.

It is further an object of the present invention to provide such novel food containers providing relatively large printing presentation areas.

It is further an object of the present invention to provide such novel food containers of a unique shape for enhanced marketing appeal.

These and further objects and advantages of the present invention will become clearer in light of the following detailed description of an illustrative embodiment of this invention described in connection with the drawings.

DESCRIPTION OF THE DRAWINGS

The illustrate embodiment may best be described by reference to the accompanying drawings where.

Figure 1:
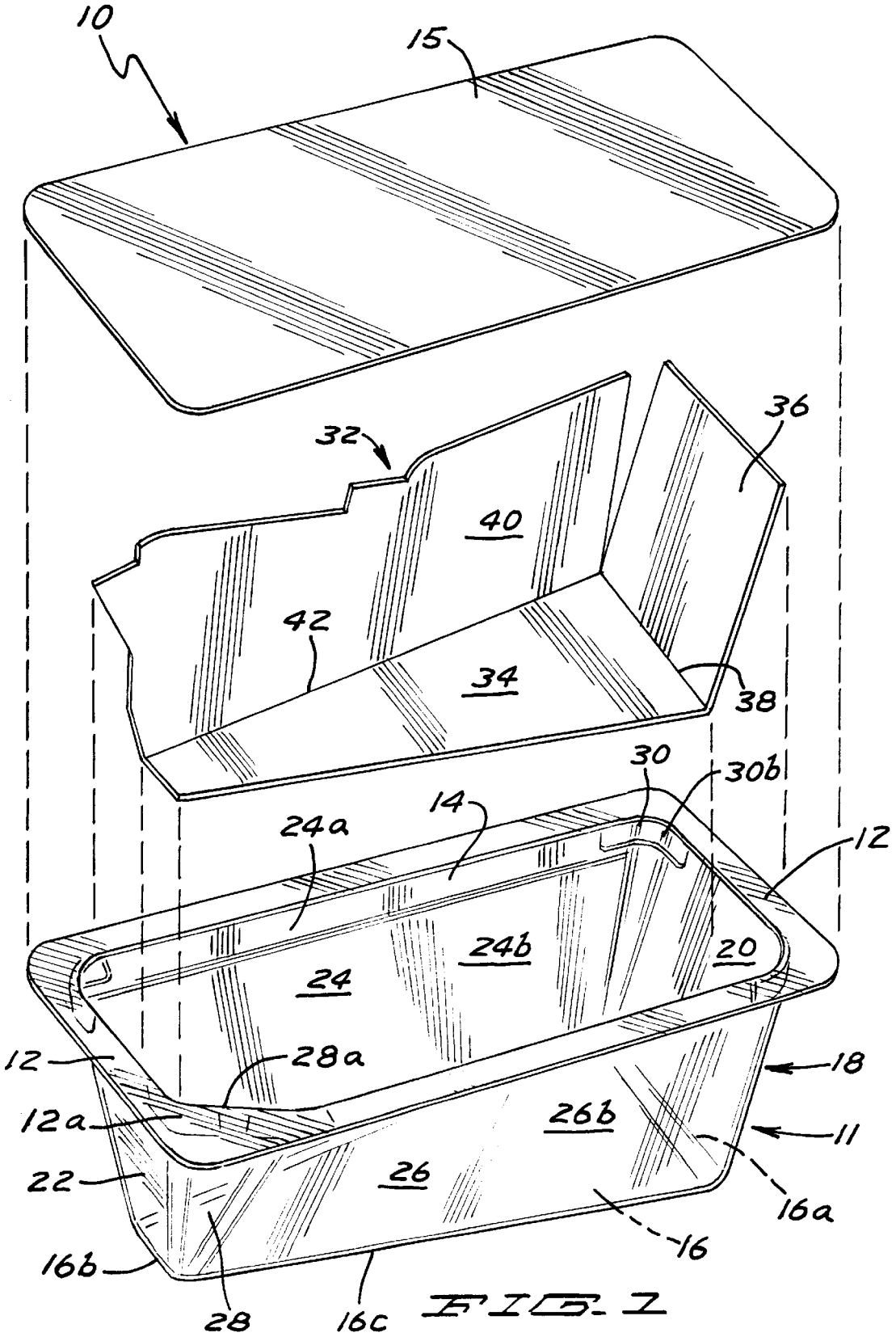
FIG. 1 shows an exploded perspective view of a refrigerated food product container formed according to the preferred teachings of the present invention.
Figure 2:
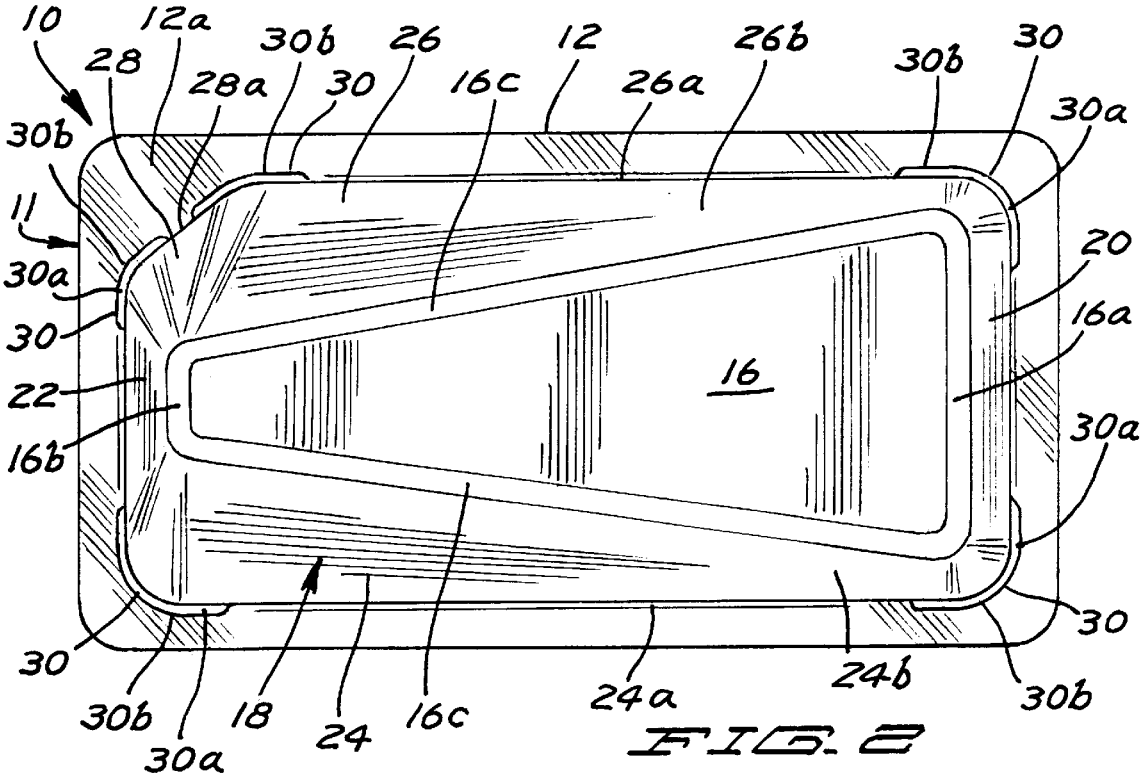
FIG. 2 shows a bottom plan view of the refrigerated food container of FIG. 1.
Figure 3:
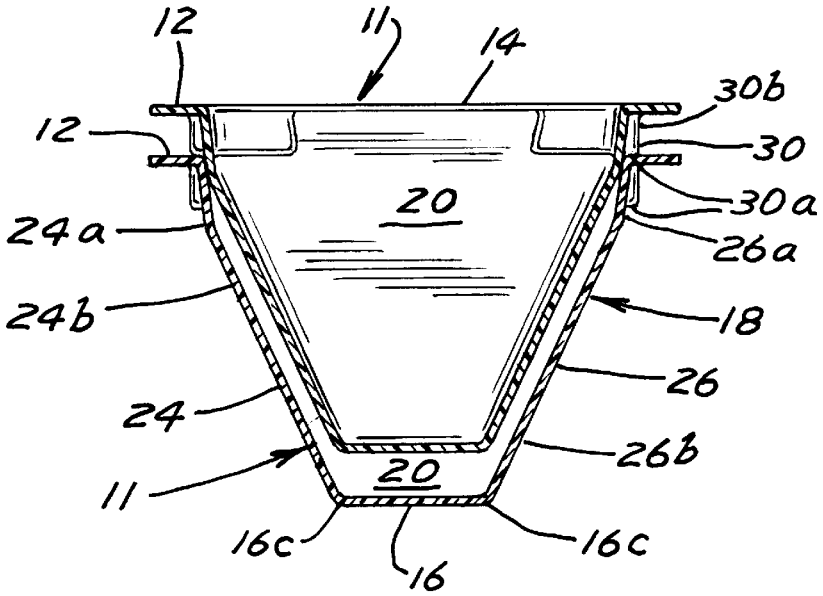
FIG. 3 shows a cross-sectional view of nested trays for the refrigerated food container of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "end", "edge", "side", "front", "back", "length", "width", "outer", and similar terms are used herein, it should be understood that these terms have reference only to the structure shown in the drawings as it would appear to a person viewing the drawings and are utilized only to facilitate describing the preferred embodiment.

DESCRIPTION

A hollow volume in the most preferred form of a refrigerated food container according to the preferred teachings of the present invention is shown in the drawings and generally designated 10. In the most preferred form, container 10 is utilized for holding single servings of pie, cake, or similar object of a wedge shape. Generally, container 10 includes a transparent thermoformed plastic tray 11. Tray 11 includes a generally planar, annular flange 12. The inner periphery or edge of flange 12 defines an upper opening 14 which in the most preferred form is generally rectangular shaped. In the most preferred form, opening 14 has a longitudinal extent which is generally 200% of the lateral extent. A closure layer 15 is heat sealed on the upper surface of flange 12 and extends over and closes opening 14. Flange 12 may abut with suitable provisions in a corrugated case which holds a plurality of such containers 10.

Tray 11 further includes a generally planar base panel or bottom 16 which is parallel to and spaced from flange 12. In the most preferred form, bottom 16 has a periphery which is generally in the shape of an isosceles trapezoid. In particular, bottom 16 includes a first, major base end edge 16*a*, a second, minor base end edge 16*b*, and first and second side edges 16*c*. The longitudinal length between edges 16*a* and 16*b* is generally equal to but slightly less than the longitudinal length of opening 14 and in the preferred form is generally equal to 95% of the longitudinal length of opening 14. The lateral width of major base edge 16*a* is generally equal to but slightly less than the lateral width of opening 14 and in the preferred form is generally equal to 80% of the lateral width of opening 14. The lateral width of minor base edge 16*b* is substantially smaller than the lateral width of edge 16*a* and of opening 14 and in the preferred form is generally equal to 25% of the lateral width of opening 14. In the most preferred form, bottom 16 includes plastic recycling information thermoformed therein.

Tray 11 further includes a sidewall 18 integrally formed and upstanding between the inner periphery of flange 12 defining opening 14 and edges 16*a*, 16*b*, and 16*c* of bottom 16. In the preferred form, sidewall 18 has cross-sectional shapes in planes parallel to flange 12 and bottom 16 which are generally rectangular shaped and in the most preferred form in the shape of a pentagon. In particular, sidewall 18 generally includes first and second ends 20 and 22, first and second sides 24 and 26 and a corner panel 28. First end 20 is generally planar in the shape of an isosceles trapezoid. The lower edge of end 20 has a lateral extent equal to, coextensive and integrally formed with edge 16*a* of bottom 16 at an angle slightly greater than 90°. The upper edge of end 20 has a lateral extent equal to and is integrally formed with the inner periphery of flange 12. The side edges of end 20 are coextensive with and integrally formed with the first end edges of sides 24 and 26, respectively.

Second end 22 is generally planar in the shape of a trapezoid. The lower edge of end 22 has a lateral width equal to, coextensive and integrally formed with edge 16*b* of bottom 16 at an angle slightly greater than 90°. The upper edge of end 20 is integrally formed with the inner periphery of flange 12. The first side edge of end 22 is coextensive and integrally formed with the second end edge of side 24. The upper edge of end 20 has a length less than the lateral length of opening 14 and in the most preferred form generally equal to 85% of the lateral length of opening 14 and extends from the upper edge of side 24 towards but spaced from the upper edge of side 26.

Corner panel 28 is generally planar and is generally triangular shaped. The base, upper edge 28*a* of the triangular shape of corner panel 28 is integrally formed with the inner periphery of flange 12 and extends at an angle in the order of 120° to the lateral axis and 150° to the longitudinal axis of opening 14 and with base edge 28*a* having a lateral extent generally equal to two thirds of its lateral extent. The first side periphery edge of corner panel 28 is coextensive and integrally formed with the second or back side edge of end 22. The second side periphery edge of corner panel 28 is coextensive and integrally formed with the second vertical side edge of side 26. The interconnection between the first and second side edges of corner panel 28 and opposite to base edge 28*a* is located at the interconnection between edges 16*b* and 16*c* of bottom 16, the interconnection between the lower edge and second side edge of end 22, and the interconnection between the lower edge and second side edge of side 26.

Sides 24 and 26 include first side portions 24*a* and 26*a*, respectively, which are generally planar and generally in the shape of a rectangle. Specifically, portions 24*a* and 26*a* have upper edges integrally formed with the inner periphery of flange 12 and lower edges generally parallel to the upper edges and spaced therefrom a distance which is substantially shorter than the distance between flange 12 and bottom 16 and in the most preferred form is generally equal to 10% of the distance between flange 12 and bottom 16. Portions 24*a* and 26*a* extend for the full longitudinal length between the side edges of sides 24 and 26. In the preferred form, portions 24*a* and 26*a* extend generally perpendicular to flange 12 and generally parallel to each other and in the most preferred form extend at a very small angle inward of tray 11.

Sides 24 and 26 further include second side portions 24*b* and 26*b*, respectively, which are generally in the shape of a rectangle. The upper edges of second side portions 24*b* and 26*b* are coextensive and integrally formed with the lower edges of first side portions 24*a* and 26*a*. The lower edges of second portions 24*b* and 26*b* are coextensive and integrally formed with side edges 16*c* of bottom 16. Due to the lesser lateral width of bottom 16 than opening 14, portions 24*b* and 26*b* extend at an angle inwardly from their upper edges to their lower edges. Due to the decreasing lateral width between side edges 16*c* of bottom 16 from edge 16*a* to edge 16*b*, the angle that portions 24*b* and 26*b* extend inwardly increases with increasing spacing from end 20 and decreasing spacing from end 22. In the preferred form, portions 24*b* and 26*b* are generally planar but are slightly concave in shape as viewed from the outside of tray 11 with the axis of the depression extending from the upper corner between the upper edges and the first side edges of sides 24 and 26 and the lower corner between the lower edges and the second side edges of sides 24 and 26.

In the most preferred form, the integral interconnections between bottom 16, ends 20 and 22, sides 24 and 26 and corner panel 28 are rounded to reduce the prospect of thinning out at the interconnections that could occur during thermoforming if the interconnections were at a sharp angle.

Tray 11 further includes nesting shoulders 30 having longitudinal and lateral extents larger than sidewall 18. Each nesting shoulder 30 includes a lower surface 30*a* generally parallel to flange 12 and bottom 16 and spaced from flange 12 less than the height of portions 24*a* and 26*a* and in the most preferred form generally equal to two thirds of the height of portions 24*a* and 26*a*. Each nesting shoulder 30 further includes a surface 30*b* integrally extending generally perpendicularly between the inner periphery of flange 12 and lower surface 30*a*. Surfaces 30*b* are generally arcuate shaped in cross sections parallel to flange 12, lower surface 30*a,* and bottom 16. In the most preferred form, nesting shoulders 30 are provided at and extend around each of the interconnections of sidewall 18 and specifically between the interconnections of end 20 and side 24, of side 24 and end 22, of end 22 and corner panel 28, of corner panel 28 and side 26, and of side 26 and end 20. While the spacing between lower surfaces 30*a* from flange 12 are equal for all nesting shoulders 30, in the preferred form nesting shoulders 30 between corner panel 28 and end 22 and side 26 are of equal length and of a smaller size than nesting shoulders between end 20 and sides 24 and 26 and between end 22 and side 24 which are of equal length and in the most preferred form include arcuate surfaces 30*b* of a length generally one half of the length of arcuate surfaces 30*b* of nesting shoulders between end 20 and sides 24 and 26 and between end 22 and side 24 in directions parallel to flange 12, bottom 16, and lower surfaces 30*a*.

In the most preferred form, the outer periphery of flange 12 is generally rectangular shaped (aside from the corners being rounded to prevent presentation of a sharp point). Generally, the inner periphery of flange 12 and thus opening 14 is generally parallel to and spaced inwardly from the outer periphery of flange 12. However, it should be appreciated that due to the provisions of corner panel 28, opening 14 defined by the inner periphery of flange 12 although of generally rectangular shape has one corner which is truncated by base edge 28*a* creating a generally triangular shaped enlarged portion 12*a* adjacent corner panel 28 with the spacing between base edge 28*a* and the outer periphery of flange 12 being greater in portion 12*a* than the spacing between the outer periphery of flange 12 and the remaining portions of sidewall 18 of flange 12.

Closure layer 15 is generally rectangular shaped of a size generally corresponding to (or slightly larger) and contiguous with the outer periphery of flange 12. Closure layer 15 is heat sealed in an annular shape having its inner periphery generally corresponding to the inner periphery of flange 12 and having its outer periphery generally concentric to its inner periphery at a spacing generally equal to the spacing between the outer periphery of flange 12 and ends 20 and 22 and sides 24 and 26. Thus, due to the increased spacing between base edge 28*a* and the outer periphery of flange 12, the outer periphery of the annular heat seal of closure layer 15 to flange 12 is spaced inwardly from the outer periphery of flange 12. Therefore, the corner of closure layer 15 adjacent edge 28*a* is not secured to flange 12 so that it can be grasped by the consumer and pulled for removing closure layer 15 from tray 11. In this regard, the outer periphery of the annular heat seal adjacent edge 28*a* could include a spike projection to aid in directing separation of closure layer 15 from tray 11 and focuses the starting forces which aid in the removal of closure layer 15 and thus provides an easy open feature.

Container 10 according to the preferred teachings of the present invention further includes a product card 32 formed of folded flat stock material such as paperboard. Generally, product card 32 includes a bottom portion 34 of a generally isosceles trapezoid shape and size corresponding to bottom 16 of tray 11. Product card 32 further includes an end portion 36 of a generally square shape integrally connected to the first end edge of portion 34 about a fold line 38. The width of end portion 36 and of bottom portion 34 along fold line 38 is generally equal to the length of edge 16*a* of tray 11. The height of end portion 36 generally perpendicular to fold line 38 is generally equal to the width of end portion 36 and less than the spacing of flange 12 and of lower surfaces 30*a* of tray 11 from bottom 16. Thus, end portion 36 is of a size and shape generally corresponding to and for abutting with end 20 of tray 11 and in the preferred form is slightly smaller than end 20.

Product card 32 further includes a side portion 40 of a generally rectangular shape integrally connected to the first side edge of portion 34 about a fold line 42. The length of side portion 40 and of bottom portion 34 along fold line 42 is generally equal to the length of edge 16*c* of tray 11. The height of side portion 40 generally perpendicular to fold line 42 is generally less than the spacing of flange 12 and of lower surfaces 30*a* of tray 11 from bottom 16 and in the most preferred form slightly less than the height of end portion 36. Thus, side portion 40 is of a size and shape generally corresponding to and for abutting with a portion of sidewall 18 and particularly side 24 of tray 11 and in the preferred form is slightly smaller than side 24. In the most preferred form, the first end edge of side portion 40 adjacent to end portion 36 is generally contiguous and linearly straight with fold line 38 while the second end edge of side portion 40 opposite to end portion 36 is generally contiguous with but at an obtuse angle in the order of 165° to the free end of bottom portion 34. In the most preferred form, the free side edge and the second end edge of side portion 40 are not linearly straight but rather are decorative in nature such as following the outline of a ribbon or similar graphic element printed on the outer surface of side portion 40.

The second end edge and the second side edge of bottom portion 34 are free of interconnection according to the preferred teachings of the present invention.

It should be appreciated that portions 36 and 40 can be pivoted relative to portion 34 about fold lines 38 and 42, respectively, to position product card 32 in the interior of tray 11. A food product such as a slice of pie, cake or the like can be positioned on the inside surface of bottom portion 34 of product card 32, with the food product having a lower surface of a shape and size generally corresponding to or slightly smaller than bottom 16 and bottom portion 34 in the most preferred form and having a size for receipt in tray 11 below opening 14. It can then be appreciated that the food product can be positioned on product card 32 either prior to or after placement of product card 32 in tray 11. With product card 32 and the food product positioned in tray 11, the outer surface of portion 34 of product card 32 flushly abuts with the inside surface of bottom 16 of tray 11 with fold line 38 abutting with end 20, fold line 42 abutting with side 24, the second end edge of bottom portion 34 abutting with end 22, and the second side edge of bottom portion 34 abutting with side 26. Also, the outer surfaces of portions 36 and 40 abut with the inside surfaces of end 20 and side 24, respectively, of tray 11. As product card 32 is formed of flat stock material, portions 36 and 40 have a tendency and are biased to pivot relative to portion 34 to a flat condition but are prevented from doing so because of their abutment with the inside surfaces of end 20 and side 24.

After the food product and product card 32 are positioned inside tray 11, closure layer 15 can be adhered to flange 12 of tray 11 such as by conventional manners. Thus, the food product is thereby sealed inside of container 10 according to the preferred teachings of the present invention. Multiple sealed containers 10 can be packaged together inside of corrugated cases or the like for storage, transport, and other handling.

In the most preferred form, tray 11 is thermoformed of clear plastic material so that the food product can be viewed through end 22 and side 26 and so that product card 32 can be viewed through bottom 16, end 20 and side 24. The outer surfaces of product card 32 viewable through tray 11 can include suitable printing including providing ingredient and nutrition information, product identification and trademarks, advertising, and other graphic elements and information as desired. The interior of tray 11 and the product contained therein can be viewed through portions of sidewall 18 and particularly end 22, side 26, and corner panel 28 of tray 11. Similarly, closure layer 15 can be formed of a clear film such as sheet polyester which allows viewing of the food product therethrough. In the preferred form, closure layer 15 can also include printing such as providing product identification and trademarks and which preferably does not extend over the entire area of closure layer 15. It should be appreciated that tray 11 is devoid of printing which is relatively expensive to provide on thermoformed materials.

Containers 10 according to the teachings of the present invention are especially adaptable for mechanical handling. In particular, trays 11 are shaped to be nestable with each other and which can be mechanically separated. Specifically, bottom 16 of an upper tray 11 can be inserted through opening 14 of a lower tray 11 with upper tray 11 slideably received in lower tray 11 until lower surfaces 30*a* of nesting shoulders 30 of upper tray 11 abut with flange 12 of lower tray 11. It should then be noted that flanges 12 of upper and lower trays 11 are in a spaced, parallel relation. Thus, flange 12 of upper tray 11 can be engaged by mechanical apparatus such as fingers and moved relative to flange 12 of lower tray 11 and thereby sliding and separating upper tray 11 from lower tray 11. It should then be appreciated that as trays 11 are formed of thermoformed plastic, trays 11 are sufficiently flexible to allow nesting shoulders 30 of upper tray 11 to undesirably enter flange 12 of lower tray 11 when forced such as by accidentally dropping the nested trays 11. The feature of sides 24 and 26 including first side portions 24*a* and 26*a* is advantageous as the receipt of first side portions 24*a* and 26*a* of upper tray 11 in first side portions 24*a* and 26*a* of lower tray 11 forces first side portions 24*a* and 26*a* of lower tray 11 outwardly to prevent a wedge between second side portions 24*b* and 26*b*. Thus, in the event that the nested trays 11 are smashed together, the nested trays 11 are not wedged together in a manner to prevent separation.

It should further be appreciated that product card 32 performs multiple functions including providing an easily printable surface for the desired printing of a relatively large presentation area. Thus, labels are not required to be adhered or otherwise positioned on the outside surfaces of sidewall 18 which may obstruct viewing through tray 11 and would be mechanically difficult for tray 11 of the most preferred form. Additionally, product card 32 provides a holder for the food product while in tray 11 but also for handling of the food product for insertion and removal of the food product in tray 11 whether performed manually or mechanically.

It should be appreciated that containers 10 according to the preferred teachings of the present invention generally imitate and conform to the shape of wedge shaped food products such as individual pieces of pie, individual slices of cheese cake, or the like. Additionally, due to the decreasing angle of sides 24 and 26 from their upper edges to their lower edges and from their first end edges to their second end edges, to the trapezoid shapes of bottom 16 and ends 20 and 22, and to the provision of corner panel 28, tray 11 and containers 10 formed therefrom provide a unique shape believed to have enhanced marketing appeal for the food product.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Food product tray comprising, in combination: a bottom having a first end edge, a second end edge, a first side edge, and a second side edge, and a generally rectangular shaped sidewall integrally formed and upstanding from the bottom and including a first end, a second end, a first side, and a second side, with the first end having a lower edge coextensive and integrally formed with the first end edge, with the second end having a lower edge coextensive and integrally formed with the second end edge, with the first and second sides each including first and second side portions, with the second side portion of the first side having a lower edge coextensive and integrally formed with the first side edge, with the second side portion of the second side having a lower edge coextensive and integrally formed with the second side edge, with the second side portions each having an upper edge and the first side portions each having a lower edge coextensive and integrally formed with the upper edge of the second side portion, with the second side portions extending at an angle inwardly from their upper edges to their lower edges, with the first portions being generally parallel to each other, with an upper tray being slideably received in a lower tray so that the upper and lower trays are nestable, with the receipt of the first side portions of the upper tray in the first side portions of the lower tray forcing the first side portions of the lower tray outwardly to prevent a wedge effect between the second side portion of the upper tray in the lower tray: wherein the spacing between the first and second side edges decreases from the first end edge to the second end edge so that the angle that the second portions extend inwardly increases with increasing spacing from the first end; wherein the sidewall further includes a corner panel of a generally triangular shape and including a first periphery edge, a second periphery edge, and a third, upper edge, with the first and second periphery edges of the corner panel interconnecting at an interconnection, with the second end edge and the second side edge of the bottom interconnecting at an interconnection located at the interconnection of the first and second periphery edges of the corner panel, with the second end including a back edge coextensive and integrally formed with the first periphery edge, with the second side including a first vertical edge coextensive and integrally formed with the second periphery edge.

2. The food product tray of claim 1 further comprising, in combination: an annular flange having an outer periphery of a generally rectangular shape and having an inner periphery, with the first and second ends each including an upper edge, with the upper edges of the first and second ends, the first side portions and the corner panel integrally formed with the inner periphery, with the annular flange including a generally triangular shaped enlarged portion adjacent the corner panel having a spacing between the outer periphery and the third upper edge of the corner panel greater than the spacing between the outer periphery and the upper edges.

3. The food product tray of claim 2 further comprising, in combination: a closure layer of a size generally corresponding to the outer periphery of the flange and heat sealed on the flange spaced from the outer periphery in the enlarged portion.

4. The food product tray of claim 1 further comprising, in combination: a plurality of nesting shoulders each having a lower surface spaced intermediate the upper and lower edges of the first side portions and located outwardly of the first side portions.

5. The food product tray of claim 4 wherein the plurality of nesting shoulders includes a first nesting shoulder extending between the first end and the first side, a second nesting shoulder extending between the second end and the first side, a third nesting shoulder extending between the first end and the second side, a fourth nesting shoulder extending between the second end and the corner panel, and a fifth nesting shoulder extending between the second side and the corner panel, with the nesting shoulders each further having an arcuate surface, with the arcuate surfaces of the first, second and third shoulders having equal lengths and which is longer than the lengths of the arcuate surfaces of the fourth and fifth nesting shoulders.

6. Food product tray comprising, in combination: a bottom having a first end edge, a second end edge, a first side edge, and a second side edge; a generally rectangular shaped sidewall integrally formed and upstanding from the bottom and including a first end, a second end a first side, and a second side, with the first end having a lower edge coextensive and integrally formed with the first end edge, with the second end having a lower edge coextensive and integrally formed with the second end edge, with the first and second sides each including first and second side portions, with the second side portion of the first side having a lower edge coextensive and integrally formed with the first side edge, with the second side portion of the second side having a lower edge coextensive and integrally formed with the second side edge, with the second side portions each having an upper edge and the first side portions each having a lower edge coextensive and integrally formed with the upper edge of the second side portion, with the second side portions extending at an angle inwardly from their upper edges to their lower edges, with the first portions being generally parallel to each other, with an upper tray being slideably received in a lower tray so that the upper and lower trays are nestable, with the receipt of the first side portions of the upper tray in the first side portions of the lower tray forcing the first side portions of the lower tray outwardly to prevent a wedge effect between the second side portion of the upper tray in the lower tray; wherein the spacing between the first and second side edges decreases from the first end edge to the second end edge so that the angle that the second portions extend inwardly increases with increasing spacing from the first end; and a product card formed of flat stock including a bottom portion of a size and shape corresponding to the bottom and having a first end edge, a second end edge, a first side edge, and a second side edge, with the bottom being generally planar, with the product card further including an end portion integrally connected to the first end edge of the bottom portion about a first fold line and of a size and shape for abutting with the first end, with the product card further including a side portion integrally connected to the first side edge of the bottom portion about a second fold line and of a size and shape for abutting with the first side, with the first fold line abutting with the first end, the second fold line abutting with the first side, the second end edge of the bottom portion abutting with the second end, and the second side edge of the bottom portion abutting with the second side, with the second end edge of the bottom portion being free of interconnection, with the product card including an outer surface including printing and an inner surface adapted for food product contact, with the bottom and sidewall being formed of transparent material for viewing the outer surface of the product card through the bottom, the first end, and the first side and for viewing the product through the second side.

7. Food product tray comprising, in combination: a bottom of an isosceles trapezoid shape having a first, major end edge, a second, minor end edge, a first side edge, and a second side edge; a generally rectangular shaped sidewall integrally formed and upstanding from the bottom and defining a rectangular opening having a longitudinal length and a lateral width, with the first, major end edge having a length, with the second, minor end edge having a length substantially less than the lateral width and than the length of the first, major end edge, with the sidewall including a first end, a second end, a first side, and a second side, with the first end having a lower edge coextensive and integrally formed with the first, major end edge, with the second end being of a trapezoid shape and having a lower edge coextensive and integrally formed with the second end edge, with the first side having a lower edge coextensive and integrally formed with the first side edge, with the second side having a lower edge coextensive and integrally formed with the second side edge, with the first and second ends and first and second sides each having an upper edge, with the upper edges defining the rectangular opening; and a product card formed of flat stock including a bottom portion of a size and shape corresponding to the bottom and having a first end edge, a second end edges a first side edge, and a second side edge, with the bottom being generally planar, with the product card further including an end portion integrally connected to the first end edge of the bottom portion about a first fold line and of a size and shape for abutting with the first end, with the product card further including a side portion integrally connected to the first side edge of the bottom portion about a second fold line and of a size and shape for abutting with the first side, with the first fold line abutting with the first end, the second fold line abutting with the first side, the second end edge of the bottom portion abutting with the second end, and the second side edge of the bottom portion abutting with the second side, with the second end edge of the bottom portion being free of interconnection, with the product card including an outer surface including printing and an inner surface adapted for food product contact with the bottom and sidewall being formed of transparent material for viewing the outer surface of the product card through the bottom, the first end, and the first side and for viewing the product through the second side.

8. The food product tray of claim 7 wherein the length of the first, major end edge is slightly less than the lateral width, with the first end being of an isosceles trapezoid shape.

9. The food product tray of claim 8 wherein the first and second side edges have a length slightly less than the longitudinal length.

10. The food product tray of claim 9 wherein the sides each include a first, generally planar side portion including the upper edge and a second, generally planar portion including the lower edge, with the first portions being generally parallel, with the second portions extending at an angle inwardly from the first portions to the lower edge.

11. Food product tray comprising, in combination: a bottom of an isosceles trapezoid shape having a first, major end edge, a second, minor end edge, a first side edge, and a second side edge, and a generally rectangular shaped sidewall integrally formed and upstanding from the bottom and defining a rectangular opening having a longitudinal length and a lateral width, with the first, major end edge having a length, with the second, minor end edge having a length substantially less than the lateral width and than the length of the first, major end edge, with the sidewall including a first end, a second end, a first side, and a second side, with the first end having a lower edge coextensive and integrally formed with the first, major end edge, with the second end being of a trapezoid shape and having a lower edge coextensive and integrally formed with the second end edge, with the first side having a lower edge coextensive and integrally formed with the first side edge, with the second side having a lower edge coextensive and integrally formed with the second side edge, with the first and second ends and first and second sides each having an upper edge, with the upper edges defining the rectangular opening; wherein the length of the first, major end edge is slightly less than the lateral width, with the first end being of an isosceles trapezoid shape; wherein the first and second side edges have a length slightly less than the longitudinal length; wherein the sides each include a first, generally planar side portion including the upper edge and a second, generally planar portion including the lower edge, with the first portions being generally parallel, with the second portions extending at an angle inwardly from the first portions to the lower edge; wherein the sidewall further includes a corner panel of a generally triangular shape and including a first periphery edge, a second periphery edge, and a third, upper edge, with the first and second periphery edges of the corner panel interconnecting at an interconnection, with the second end edge and the second side edge of the bottom interconnecting at an interconnection located at the interconnection of the first and second periphery edges of the corner panel, with the second end including a back edge coextensive and integrally formed with the first periphery edge, with the second side including a first vertical edge coextensive and integrally formed with the second periphery edge.

12. The food product tray of claim 11 further comprising, in combination: an annular flange having an outer periphery of a generally rectangular shape and having an inner periphery, with the first and second ends each including an upper edge, with the upper edges of the first and second ends, the first side portions and the corner panel integrally formed with the inner periphery, with the annular flange including a generally triangular shaped enlarged portion adjacent the corner panel having a spacing between the outer periphery and the third upper edge of the corner greater than the spacing between the outer periphery and the upper edges.

13. The food product tray of claim 11 further comprising, in combination: a first nesting shoulder extending between the first end and the first side, a second nesting shoulder extending between the second end and the first side, a third nesting shoulder extending between the first end and the second side, a fourth nesting shoulder extending between the second end and the corner panel, and a fifth nesting shoulder extending between the second side and the corner panel, with the nesting shoulders each having a lower surface spaced from the upper edges, with the nesting shoulders each further having an arcuate surface, with the arcuate surfaces of the first, second and third shoulders having equal lengths and which is longer than the lengths of the arcuate surfaces of the fourth and fifth nesting shoulders.

14. Food product container comprising, in combination: a transparent, thermoformed tray including a generally planar bottom having a first side edge and a second side edge, with the tray further including a sidewall integrally formed and upstanding from the first and second side edges of the bottom and defining an upper opening; and a product card formed of flat stock including a bottom portion of a size and shape corresponding to the bottom and having a first side edge and a second side edge, with the product card further including a side portion integrally connected to the first side edge of the bottom portion about a first fold line and of a size and shape for abutting with a portion of the sidewall, with the product card including an outer surface including printing and an inner surface adapted for food product contact, with the product card being insertable through the upper opening with the outer surface of the bottom portion flushly abutting with the bottom with the first fold line abutting with the sidewall and the second side edge being free of interconnection and abutting with the sidewall, with the outer surface of the side portion abutting with the sidewall, with the sidewall including other portions which are unobstructed for viewing the interior of the tray, with the outer surface of the product card being viewable through the bottom and the sidewall of the tray.

15. The food product tray of claim 14 wherein the side portion is biased to pivot about the first fold line to be generally in the same plane as the bottom portion to abut with the sidewall.

16. The food product tray of claim 15 wherein the bottom further includes a first end edge and a second end edge, with the product card further including an end portion integrally connected to the second end edge of the bottom portion about a second fold line and of a size and shape for abutting with the sidewall, with the second end edge being free of interconnection and abutting with the sidewall.

17. The food product tray of claim 16 wherein the bottom is of an isosceles trapezoid shape with the first end edge having a greater length than the second end edge, with the end portion being of a square shape with the second fold line being coextensive with the first end edge, with the side portion including an end edge generally contiguous and linearly straight with the second fold line.

* * * * *